US006374812B1

(12) United States Patent
Wiese

(10) Patent No.: US 6,374,812 B1
(45) Date of Patent: Apr. 23, 2002

(54) METHOD OF REGENERATING AN ACTIVATED-CARBON CANISTER

(75) Inventor: Matthias Wiese, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/677,547

(22) Filed: Oct. 2, 2000

(30) Foreign Application Priority Data

Sep. 30, 1999 (DE) ..... 199 47 097

(51) Int. Cl.[7] ..... F02M 37/04
(52) U.S. Cl. ..... 123/520; 123/680
(58) Field of Search ..... 123/516, 518, 123/519, 520

(56) References Cited

U.S. PATENT DOCUMENTS 4,886,026 A * 12/1989 Cook ..... 123/520
5,909,726 A * 6/1999 Kobayashi et al. ..... 123/520
6,098,605 A * 8/2000 Brooks ..... 123/680

* cited by examiner

*Primary Examiner*—Thomas N. Moulis
(74) *Attorney, Agent, or Firm*—Herbert L. Lerner; Laurence A. Greenberg; Werner H. Stemer

(57) ABSTRACT

The fill level of an activated-carbon canister is calculated during the regeneration process in a lean burn combustion engine. While the engine is in idle operation, the fuel mass reduction that is adjusted by a momentum-based idle controller is used as a measure of the hydrocarbon mass flow that is delivered in the regeneration process, when the activating-carbon filter is flushed back into the engine via its intake tract.

5 Claims, 2 Drawing Sheets

METHOD OF REGENERATING AN ACTIVATED-CARBON CANISTER

BACKGROUND OF THE INVENTION

Field of the Invention

The invention relates to a method for regenerating an activated-carbon canister that is laden with hydrocarbons. The activated-carbon canister is bound into a tank ventilation system of a fuel tank of an internal combustion engine and thereby adsorbs gaseous hydrocarbons that arise in the fuel tank. In the generic method, the activated-carbon canister is regenerated in a selected operating mode of the internal combustion engine, a flushing flow with hydrocarbons from the activated-carbon canister is conducted into an intake tract of the internal combustion engine downstream from a throttle element that is located in the intake tract, whereby flushing flow is fed to the combustion process, and whereby a deviation signal is evaluated, which is utilized as a measure of the hydrocarbon mass flow contained in the flushing flow. From that signal, it is possible to calculate a load level of the activated-carbon canister.

In addition to liquid fuel, there is always gaseous fuel present in the tank of a motor vehicle by virtue of the vapor pressure. Since the tank must have a ventilation opening to equalize pressure, hydrocarbons would continuously leak into the atmosphere due to the evaporation of fuel. That effect rises with the temperature of the fuel. Such hydrocarbon emissions can be prevented using activated-carbon canisters which are inserted into the ventilation line and which adsorb evaporated hydrocarbons from the tank. These measures are necessary in order to satisfy the regulatory limits with regard to evaporation losses.

The tank is thus ventilated only via an activated-carbon canister. Because the uptake volume of the activated carbon is limited, the activated-carbon canister, or rather the activated carbon therein, must be regenerated. To this end, while the internal combustion engine is running, environmental air is aspirated in via the activated-carbon canister, fed into the intake tract via a regeneration line, and delivered to the internal combustion engine for combustion. In this process the underpressure in the intake tract is exploited to suck in the air via the regeneration line. In order to keep the pollution emission within desirable limits without adversely affecting the run characteristics of the internal combustion engine, air that is sucked through the activated-carbon canister and is enriched with hydrocarbons therein must be purposefully conducted into the intake tract of the internal combustion engine, and the normal fuel metering must be corrected, for instance by an injection correction.

Commonly assigned U.S. Pat. No. 5,988,151, (German patent DE 107 01 353 C1), which discloses the generic method mentioned above, teaches that an injection correction such as this is accomplished by the lambda control that is already present in an internal combustion engine equipped with a three-way catalytic converter.

To this end, a control system controls a regenerating valve which is inserted in the regeneration line. By appropriately opening the regenerating valve, it is possible to set the flushing flow which is sucked in through the activated-carbon canister and led into the intake tract. The flushing mass flow is a function of the cross-section of the opening that is opened by the regenerating valve, the pressure difference between the intake tract and the atmosphere, and the temperature of the flushing flow.

But ultimately it is not the flushing flow that is critical, but the mass flow of the activated hydrocarbon that is introduced. This is a product of the flushing mass flow and the concentration of hydrocarbons in the flushing flow. This concentration is ultimately determined by the load level of the activated-carbon canister.

According to U.S. Pat. No. 5,988,151 (DE 197 01 353 C1), normal operation is guaranteed with the aid of a lambda control at lambda=1. Thus, it is possible to obtain a measure of the hydrocarbon mass flow that was introduced into the intake tract during regeneration from the unbalance of the lambda controller, along with a measure of the load level of the activated-carbon canister when the flushing flow is known.

Therefore, in internal combustion engines which are not driven with a lambda control or whose lambda signal is not indicated with sufficient resolution—such as is the case with lean burn internal combustion engines in the stratified lean burn operation—this procedure is not possible.

SUMMARY OF THE INVENTION

The object of the invention is to provide a method for regenerating an activated carbon canister that is laden with hydrocarbons which overcomes the above-noted deficiencies and disadvantages of the prior art devices and methods of this kind, and which allows the regeneration to occur independent of a lambda control.

With the above and other objects in view there is provided, in accordance with the invention, a method of regenerating an activated-carbon canister in a tank ventilation system of a fuel tank of an internal combustion engine adsorbing gaseous hydrocarbons from the fuel tank. The method comprises the following steps:

- regenerating the activated-carbon canister in an idle operation of the internal combustion engine, during which the internal combustion engine is driven without lambda control;
- conducting a flushing flow with hydrocarbons from the activated-carbon canister into an intake tract of the internal combustion engine downstream from a throttle element in the intake tract, and feeding the flushing flow to a combustion process;
- reducing a fuel quantity to the internal combustion engine with an idle controller controlling the internal combustion engine by a differential to compensate for a hydrocarbon mass flow delivered with the flushing flow; and
- evaluating the differential and calculating a load level of the activated-carbon canister.

In accordance with an added feature of the invention, a total mass flow of the flushing flow is determined as a function of an underpressure in an intake tract of the internal combustion engine and an opening angle of a regeneration valve switching the flushing flow into the intake tract, and computing the load level as a quotient of a hydrocarbon mass flow and the total mass flow of the flushing flow.

In accordance with an additional feature of the invention, a relationship between the reduced fuel quantity and the hydrocarbon mass flow is determined from an operating-parameter-dependent engine characteristic map.

In accordance with another feature of the invention, the flushing flow is increased continuously.

In accordance with a concomitant feature of the invention, the flushing flow is controlled by repeatedly opening and closing a regeneration valve connected to switch the flushing flow into the intake tract, and a duty factor of the repeated opening and closing is increased for constantly increasing the flushing flow.

In other words, the regeneration occurs when the internal combustion engine is idling, when it is driven without lambda control, for instance in a stratified lean burn operation. With the aid of a momentum-based idle controller, the no-load operation is held constant while the flushing flow rises in a sloping fashion. The idle controller responds to the hydrocarbon mass flow that is delivered with the flushing flow with a reduction of the fuel mass which is delivered, for instance by direct injection, to the internal combustion engine in the stratified lean burn operation. The resulting reduced fuel quantity is a measure of the hydrocarbon mass flow.

However, the delivered hydrocarbon mass flow does not lead exclusively to a speed-enhancing torque. A portion of the hydrocarbons that are delivered with the regeneration gives rise to a temperature elevation in the exhaust tract or manifests itself in elevated hydrocarbon emissions in the exhaust gas. This dividing of the effect of the hydrocarbons that are delivered with the flushing flow lends the method an additional robustness, since the reduced fuel quantity that must be taken into account by the idle controller is thus lower than the amount of hydrocarbons introduced with the flushing flow. Therefore, this situation is preferably expressed in an engine characteristic map that is obtained in advance, with the aid of which the reduced fuel quantity amount is correlated with the hydrocarbon mass flow. Once knowledge of the hydrocarbon mass flow is obtained in this way, the load level of the activated-carbon canister can be calculated, together with the total mass flow of the flushing flow, by forming the quotient of the hydrocarbon mass flow and the mass flow of the flushing flow. The latter is derivable as a function of the intake tube underpressure and the opening of the regeneration valve which is located between the activated-carbon canister and the intake tract and which is appropriately switched in order to set the flushing flow.

Once the load level of the activated-carbon canister is known, it is then possible to feed a hydrocarbon mass flow to the combustion process at arbitrary operating points of the internal combustion engine in a purposeful manner and to take this into account in the normal fuel metering (injecting) process accordingly.

Because of the higher stability of the idle controller due to the fact hat the hydrocarbons only partly give rise to a speed momentum, the inventive method has the advantage that in the stratified lean burn operation lower requirements are placed on the precision of the regeneration valve when the flushing flow must be increased in a sloping manner in known fashion. Finally, with the inventive method it is possible for the first time to determine the load level of the activated-carbon canister in operating phases in which a lambda control is not present and the lambda signal does not allow an inference to be made with sufficient exactness as to the hydrocarbon mass flow that is delivered with the flushing flow.

Other features which are considered as characteristic for the invention are set forth in the appended claims.

Although the invention is illustrated and described herein as embodied in a method for regenerating an activated-carbon canister, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
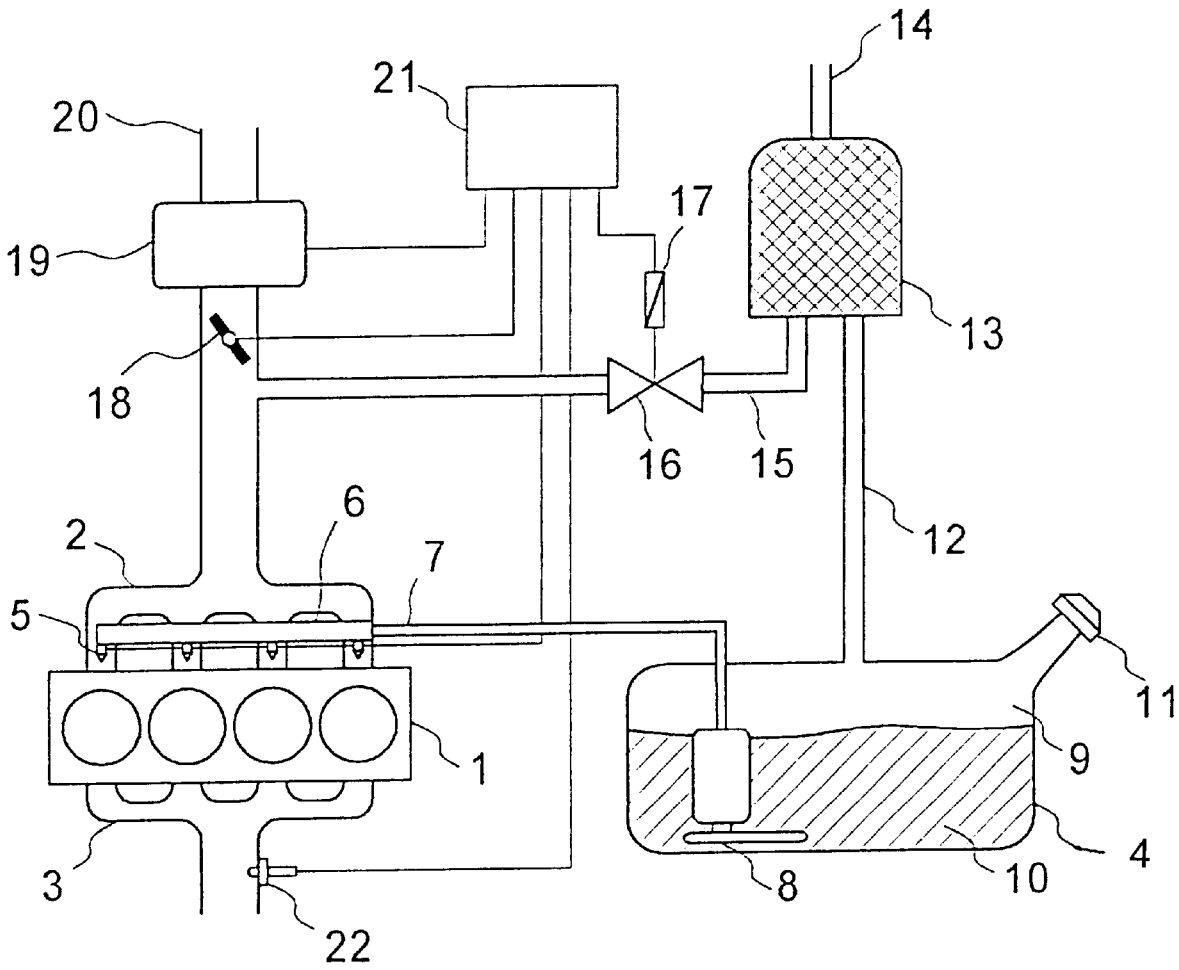
FIG. 1 is a block wiring diagram of a fuel injection engine having a tank, an activated-carbon filter, and a device required for regeneration.

Referring now to the figures of the drawing in detail and first, particularly, to FIG. 1 thereof, there is seen a schematic of an internal combustion engine 1 having an intake tract 2 into which fuel is injected via injection valves 5, which are supplied with fuel by an injection rail 6. In the intake tract 2 there is a throttle valve 18 and upstream therefrom an air-flow meter 19 into which induced air is conducted via an intake opening 20.

The injection rail 6 is supplied with fuel via a fuel line 7, which is fed from a pump module 8. The pump module 8 rests in a tank 4 which can be filled via a spout 11. Fuel 10 is located in the tank 4. The hollow space of the fuel tank 4 which is located above the fuel 10 is filled with fuel vapor 9. The tank 4 is coupled with the environment via a tank ventilation line 12 that opens into a ventilation terminal or vent 14, enabling pressure equalization.

An activated-carbon canister 13, also referred to as an activated-carbon filter 13, in which activated-carbon material that adsorbs hydrocarbons is located, is inserted into the tank ventilation line 12. This guarantees that hydrocarbons from the tank ventilation line 12 cannot be released to the ventilation terminal 14, since the hydrocarbons are absorbed in the activated-carbon material. The activated-carbon canister 13 is connected to the intake tract 2 of the internal combustion engine via a regeneration line 15, whereby the regeneration line 15 opens into the intake tract 2 between the internal combustion engine 1 and the throttle valve 18. A regeneration valve 16, which is actuated via an actuator 17, is inserted into the regeneration line 15. The regeneration valve 16 is also referred to as a tank ventilation valve. A control device 21 is connected, via corresponding signal lines or via a system bus, to the air-flow meter 19, the throttle valve 18, the injection valves 5, and the actuator 17 of the regeneration valve 16, as well as to a lambda probe 22 that is located in the exhaust tract 3 of the internal combustion engine 1. The control device 21 reads the corresponding measurement values via these lines and controls the corresponding components.

The activated-carbon canister 13 adsorbs fuel vapor. In order to prevent hydrocarbons from breaking through to the ventilation terminal 14 when the filter 13 is fully loaded, the activated-carbon filter 13 is regenerated in the operation of the internal combustion engine. This is accomplished in that, by switching the regeneration valve, a flushing flow through the regeneration line 15 is generated, which flows from the ventilation terminal 14 into the intake tract 2 through the activated-carbon canister 13. The underpressure in the intake tract is exploited in this process, and the flushing flow is propelled by the underpressure. Since the flushing flow through the regeneration line 15 contains hydrocarbons, the flushing produces a hydrocarbon addition into the air-flow that is taken in by the internal combustion engine 1 through the intake tract 2.

In an internal combustion engine that is driven under lambda control, the hydrocarbon addition is accounted for in known fashion as described below with reference to FIG. 3.

Figure 3:
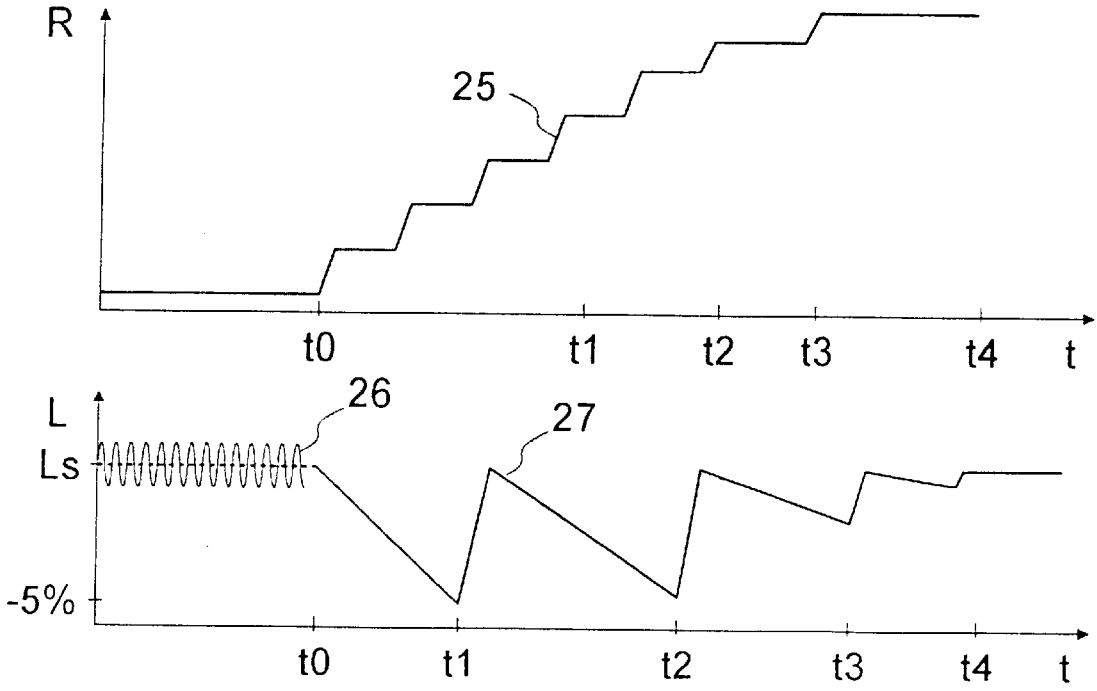
FIG. 3 is a timing graph of the control of the regeneration valve of FIG. 2 together with the lambda signal in a lambda control loop according to the prior art.

Curve 25 of the upper time graph of FIG. 3 shows the gradually growing opening of the regeneration valve 16. In this time series the opening angle R is plotted over the time t. The lower time series of FIG. 3 shows a controlled variable L that is obtained from the signal of the lambda probe 22 in the lambda control plotted over the time t. As indicated in curve 26, the controlled variable L oscillates about a target value Ls. For the sake of providing a simpler representation, beyond time t0 only the solid mean value of the controlled variable L is represented in curve 27 in FIG. 3. At a time t0 the regeneration valve 16 is gradually being opened wider, as can be seen in curve 25. The time characteristic of the controlled variable L responds with a downward deviation. When a maximum permissible control deviation—which amounts to 5% in the example of FIG. 3—is reached at time t1, the injection at the internal combustion engine 1 via the injection valves 5 is corrected by the lambda control that is performed by the control device 21, in such a way that the controlled variable L is returned to the target value Ls. This is the first upward spike in the curve 27. Over the resulting control cycles, wherein the control variable L is returned to the target value Ls each time a maximum permissible control deviation is attained (that is to say, upon the expiration of a defined time-span) at times t2, t3, the control deviation is integrated. At time t4, at which the gradually increasing opening of the regeneration valve 16 is completed, the total amount of the deviation of the controlled variable L that resulted from the flushing flow is thus known. This total amount is a measure of the hydrocarbon mass flow and also permits the calculation of the load level. Of course, at any time the hydrocarbon mass flow can also be correlated to the respectively integrated deviation of the controlled variable L from the target value Ls, which permits the determination of the load level at any time given knowledge of the total mass flow of the flushing flow. But this can be determined easily from the opening angle R of the regeneration valve 16, the underpressure in the intake tract 2, and the temperature of the flushing flow.

This process, which is taught by U.S. Pat. No. 5,988,151 (DE 197 01 353), is useful only when the internal combustion engine is in the lambda controlled operating mode, or when the resolution of the controlled variable L—that is to say, of the signal of the lambda probe 22 on which this is based—allows a sufficient determination of the mass flow of hydrocarbons. In a lean burn operation of a combustion engine, however, and particularly in a stratified lean burn operation, these conditions are not present.

Figure 2:
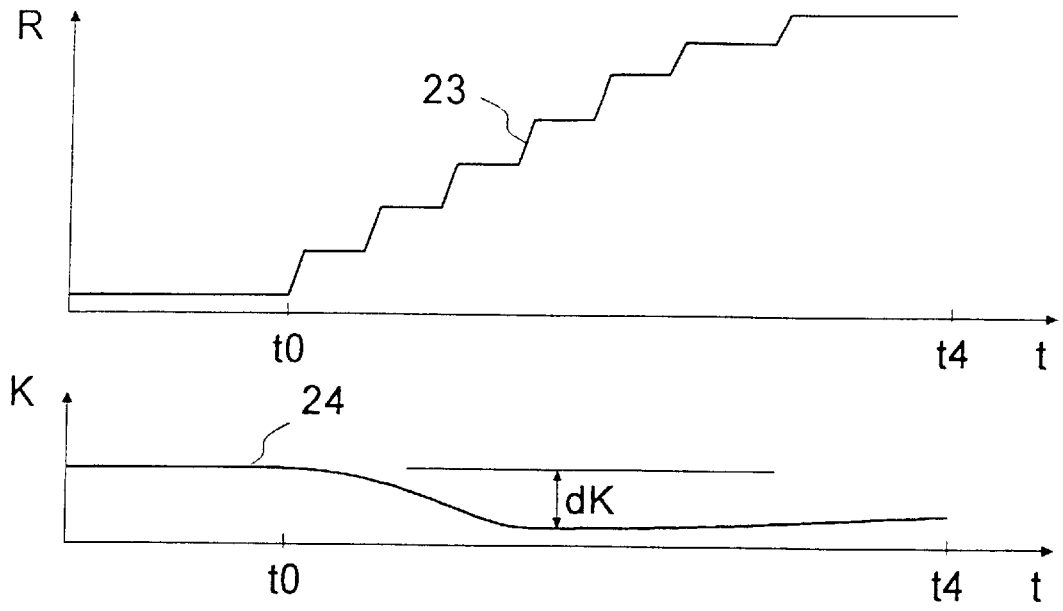
FIG. 2 is a timing graph of the control of a regeneration valve and the fuel mass, which is taken into account by an idle controller during the no-load operation, for operating the internal combustion engine in the stratified lean burn operation.

In order to be able to compute the load level of the activated-carbon canister 13 even in a lean burn operation of the internal combustion engine 1, the following procedure is followed:

With reference to FIG. 2, the regeneration valve 16 is gradually opened as represented in curve 23. As a measure of the hydrocarbon mass flow that is introduced into the intake tract 2 via the regeneration line 15 with the flushing flow, the fuel mass K is used, which is represented in curve 24, this being set by a momentum-based idle controller (which can be realized in the control device 21, for instance) to drive the internal combustion engine in idle. In this embodiment, this idle controller is fuel-flow-driven. As the time series of curve 24 shows, from the time to at which the regeneration valve 16 is gradually opened wider, the fuel masses K that the idle controller meters out to the internal combustion engine 1 via the injection valves 5 begin to diminish. At a time t1 the maximum fuel mass reduction dK is achieved. This means that at the time t1 the maximum hydrocarbon mass flow is delivered with the flushing flow. This fuel mass reduction then declines again conditional to the unloading of the activated-carbon canister 13.

The fuel mass reduction dK can now be used to compute the hydrocarbon mass flow that is fed to combustion with the flushing flow, and from that the load level of the activated-carbon canister 13. But this process must account for the fact that only a certain portion of the hydrocarbon mass flow gives rise to a torque which would result in a speed increase if the idle controller did not correspondingly reduce the fuel mass K by dK. Part of the hydrocarbon mass flow is expressed in an elevated hydrocarbon emission in the exhaust tract 3 and in a temperature increase. The hydrocarbon mass reduction dK which is integrated over time t is therefore converted into a hydrocarbon mass flow with the aid of an engine characteristic map. Of course, this engine characteristic map is preferably spread not only over the fuel mass reduction dK, but also over other operating parameters of the internal combustion engine, such as fuel mass, mass flow of induced air, or engine speed.

The characteristic map is calculated once at a test bed or performance tester and can then be used.

The sloping rise of the opening angle R of the regeneration valve 16 as represented in the curves 23 and 25 can be achieved by the repeated opening and closing of the regeneration valve with gradually increasing duty factors, for instance; what is critical is that the flushing flow grows and not the increase in the opening angle. Accordingly, other measures for raising the flushing flow are also imaginable, such as varying the underpressure in the intake tract 2 or using a proportional valve.

I claim:

1. A method of regenerating an activated-carbon canister in a tank ventilation system of an internal combustion engine adsorbing gaseous hydrocarbons, the method which comprises:

flushing the activated-carbon canister in an idle operation of the internal combustion engine, during which the internal combustion engine is driven without lambda control;

conducting a flushing flow with hydrocarbons from the activated-carbon canister into an intake tract of the internal combustion engine downstream from a throttle element in the intake tract, and feeding the flushing flow to a combustion process;

reducing a fuel quantity to the internal combustion engine with an idle controller controlling the internal combustion engine by a differential to compensate for a hydrocarbon mass flow delivered with the flushing flow; and evaluating the differential and calculating a loading level of the activated-carbon canister.

2. The method according to claim 1, which comprises determining a total mass flow of the flushing flow as a function of an underpressure in an intake tract of the internal combustion engine and an opening angle of a regeneration valve switching the flushing flow into the intake tract, and computing the load level as a quotient of a hydrocarbon mass flow and the total mass flow of the flushing flow.

3. The method according to claim 1, which comprises obtaining a relationship between the reduced fuel quantity and the hydrocarbon mass flow from an operating-parameter-dependent engine characteristic map.

4. The method according to claim 1, which comprises increasing the flushing flow continuously.

5. The method according to claim 4, which comprises controlling the flushing flow by repeatedly opening and closing a regeneration valve connected to switch the flushing flow into the intake tract, and increasing a duty factor of the repeated opening and closing for constantly increasing the flushing flow.

* * * * *